US005306114A

United States Patent [19]

Eaton

[11] Patent Number: 5,306,114

[45] Date of Patent: Apr. 26, 1994

[54] ELEVATING SCAFFOLD TRAILER

[76] Inventor: Jay S. Eaton, Rte. 2, Buladean, Bakersville, N.C. 28705

[21] Appl. No.: 842,231

[22] Filed: Feb. 26, 1992

[51] Int. Cl.[5] ..... B60D 1/00

[52] U.S. Cl. ..... 414/498; 414/495; 414/607; 414/26; 414/476; 294/5.5; 56/27.5

[58] Field of Search ..... 414/474, 475, 482, 476, 414/495, 458, 498, 26, 508, 920, 608, 607, 745.7, 745.4, 745.1; 294/26, 5.5; 56/27.5

[56] References Cited

U.S. PATENT DOCUMENTS

| | | | |
|---|---|---|---|
| 2,670,094 | 2/1954 | Kizis | 414/608 |
| 2,833,425 | 5/1958 | Lee | 414/26 |
| 2,904,193 | 9/1959 | Poythress . | |
| 3,036,413 | 5/1962 | Schulte | 414/745.7 X |
| 3,165,208 | 1/1965 | Lewis . | |
| 3,250,405 | 5/1966 | Rosser | 414/26 |
| 3,262,587 | 7/1966 | Anderson . | |
| 3,342,353 | 9/1967 | Davis | 414/498 X |
| 3,424,489 | 1/1969 | Hoy . | |
| 3,542,226 | 11/1970 | Hutton . | |
| 3,580,386 | 5/1971 | Arnould et al. . | |
| 3,802,006 | 4/1974 | Nelson et al. . | |
| 3,902,607 | 9/1975 | Middleton | 414/26 |
| 3,921,824 | 11/1975 | Larroche | 414/26 X |
| 3,999,303 | 12/1976 | Martin et al. . | |
| 4,053,072 | 10/1977 | Rossetal | 414/495 |
| 4,361,002 | 11/1982 | Swetnam et al. . | |
| 4,510,740 | 4/1985 | Foster | 414/26 X |
| 4,618,307 | 10/1986 | Kress et al. . | |
| 4,735,545 | 4/1988 | Knijpstra | 414/498 X |

*Primary Examiner*—Frank E. Werner
*Attorney, Agent, or Firm*—Dority & Manning

[57] ABSTRACT

An elevating scaffold trailer is provided for transporting burley tobacco stalks impaled on tobacco rods from the field into a curing cell and subsequently out of the curing cell. The trailer comprises an elevating device for raising tobacco rod carrying devices above the height of holding racks within the curing cell. The trailer is transported into the curing cell whereby the elevating device lowers the tobacco rod carrying device below the level of the holding racks so that the tobacco rods are transferred to the holding racks. A method for gathering and transporting burley tobacco to a curing cell is also provided. The method involves using the elevating wheeled scaffold trailer to transport cut burley tobacco stalks to the curing cell and for transferring the tobacco to holding racks within the curing cell.

20 Claims, 6 Drawing Sheets

ELEVATING SCAFFOLD TRAILER

BACKGROUND OF THE INVENTION

The present invention relates to an Elevating Scaffold Trailer and more particularly to an apparatus and method for transporting cut burley tobacco stalks to and from a curing cell and for transferring the cut tobacco stalks to and from holding racks within the curing cell.

Burley tobacco plants grow as relatively tall stalks with the tobacco leaves growing radially out from the stalks. In the past, when the burley tobacco plant stalks are cut down, the widest portion (bottom of the stalk) of the main stem is manually skewered onto a wooden stake which has a sharpened point affixed at one end thereto. Generally, each stake is about five or six feet long, and about five or six different plants are threaded onto each stake and pushed toward the intermediate portion of the stake away from the opposite free ends of the stake. The stakes would then be carried, to wooden curing sheds.

The stakes would then be manually hung across beams or supports within the curing shed and packed fairly tightly therein. The stakes were usually stored in levels or tiers within the wooden curing shed, generally three or four tiers of tobacco stakes would be hung within any single curing shed. This is a very labor intensive operation requiring many man hours and fairly dangerous work conditions.

Previously, the tobacco stakes were either carried to the curing sheds by workers or loaded onto trailers and driven to the curing sheds. Once at the sheds, the stakes were manually transferred to the supports within the curing shed. Mechanical means, such as the tobacco stick elevator disclosed by Arnold U.S. Pat. No. 3,580,386, may have been employed to raise the tobacco sticks to their appropriate tiers within the curing shed.

Trailers with vertically adjustable frames are disclosed in the art. U.S. Pat. No. 4,618,307 to Kress et al. discloses a carrier for lifting and transporting a scrap bucket supported in a stand having a rectangular lower frame. The carrier includes a trailer which may be raised and lowered with respect to its support wheels.

Likewise, U.S. Pat. No. 3,424,489 to Hoy discloses a transport vehicle having an upper deck disposed above a lower deck. The patent discloses apparatus for lowering the rear end of the upper deck to a position from which it may be loaded in a fashion similar to and as easily as the lower deck is loaded. The front of the upper and lower decks are pivoted relative each other and the rear ends are connected through a toggle linkage.

U.S. Pat. No. 3,802,006 to Nelson et al. discloses a boat trailer including a rack arrangement that is rotatably mounted on a frame. The rack consists of a number of vertical posts having one end pivotally mounted between stringers of a frame. A pair of braces connect the post. A cable and wench are used to rotate the post and braces upward.

U.S. Pat. No. 3,542,226 to Hutton discloses a portable dolly having a vertically movable bed containing a plurality of pole conveying rollers journaled therein to assist in the loading and unloading of wire poles from the bed of the dolly. A built-in jack means may be provided for raising and lowering the bed above the frames.

U.S. Pat. No. 3,165,208 to Lewis. U.S. Pat. No. 3,262,587 to Anderson. U.S. Pat. No. 3,580,386 to Arnould et al., and U.S. Pat. No. 4,361,002 to Swetnam et al. disclose various holders for sticks used to mount tobacco stalks.

OBJECTS AND SUMMARY OF THE INVENTION

It is a principle object of the present invention to provide an elevating trailer which allows a single operator to unload a relatively large number of tobacco rods into a curing cell.

A further object of the present invention is to provide a transportable elevating trailer for carrying cut tobacco stalks impaled on tobacco rods from the field to a curing cell and for transferring the rods to and from holding racks in the curing cell directly from the trailer.

Still a further object of the present invention is to provide an elevating scaffolding trailer which can be lowered to a convenient height for workers to place tobacco rods having tobacco stalks impaled thereon upon carrying means on the trailer and whereby the trailer can then be raised to a height above holding racks within a curing cell so that the tobacco rods can be transferred to the holding racks.

Still another object of this invention is to provide an elevating trailer for carrying tobacco rods which has a simple mechanical elevating means that can be operated by a single worker.

Yet a further object of the present invention is to provide a transportable elevating trailer having convenient stations therearound whereby a worker can secure a tobacco rod to the trailer for impaling tobacco stalks thereon.

Still another object of the present invention is to provide an elevating trailer for harvesting burley tobacco.

It is also an object of the present invention to provide an apparatus for carrying and transporting tobacco impaled on tobacco rods into or out of a curing cell and for positively placing and depositing the tobacco rods upon racks in the curing cell.

Yet another object of the present invention is to provide an elevating trailer for use in harvesting tobacco and transporting the tobacco to a curing cell, the trailer being compatible with any number of work vehicles, such as a tractor or truck.

Still a further object of the present invention is to provide a method for gathering and transporting burley tobacco stalks to any manner of curing cell having holding racks for storing the tobacco for curing.

And still another object of the present invention is to provide a method for transporting cut burley tobacco stalks to a curing cell and transferring the stalks to racks within the curing cell whereby a single worker can accomplish the transporting and transferring operations.

Additional objects and advantages of the invention will be set forth in part in the description which follows, and in part will be obvious from the description or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a transportable elevating trailer for carrying tobacco impaled on tobacco rods into a curing cell and for positively placing and depositing the tobacco rods upon holding racks within the curing cell is provided. The transportable trailer according to the present invention comprises a wheeled base: a generally upright frame structure raisably supported on the wheeled base; means for carrying tobacco rods, the carrying means being supported by the frame structure generally at the top thereof and running generally lengthwise along the frame structure; means for posi7 tioning and maintaining the tobacco rods along the carrying means at predetermined intervals, the positioning means being disposed along the carrying means; and means for controllably elevating the frame structure so that the frame structure can be raised and lowered a predetermined height relative to the wheeled base, the elevating means being operatively connected between the frame structure and the wheeled base whereby the carrying means can be raised to a height above holding racks within a tobacco curing cell and the trailer can be moved into the curing cell with the carrying means being subsequently lowered to a height below the holding racks so that the tobacco rods carried by the carrying means are deposited upon the holding racks as the carrying means are lowered below the holding racks by the elevating means.

In one preferred embodiment of this invention, the wheeled base may comprise a single axle with attached wheels with the frame structure being pivotally supported on the axle. Likewise, the wheeled base may comprise two axles with attached wheels, or any number of axles and supporting connecting structure.

The carrying means according to the present invention may comprise elongated boards or rails having recessed alternating intervals cut or formed into the rails or boards along the length thereof. The recessed intervals are configured so that they form a depository or resting position for the tobacco rods. The opposite ends of the tobacco rods extend beyond each of the carrying means so that the tobacco rods can be transferred to the holding racks in the curing cell as the carrying means are lowered between and below the holding racks.

In an alternative embodiment of the invention, the positioning means may comprise protuberances spaced along the carrying means, such as a simple staple or bolt. In this embodiment, the tobacco rods rest on the carrying means between the protuberances.

The elevating means according to the present invention preferably comprises a hydraulic lifting apparatus which includes at least one hydraulic piston for raising the frame structure above the wheeled base. In one preferred embodiment, the frame structure is pivotally mounted to the wheeled base and a hydraulic piston is operatively connected between the wheeled base and the frame structure. In this embodiment, when the hydraulic piston is retracted, it causes the frame structure to rotate upwards and away from the wheeled base. The control station for the hydraulic lifting apparatus may be positioned on the frame structure or, alternatively, may be positioned on a work vehicle configured to pull the elevating trailer.

In a preferred embodiment of this invention, hitching means are provided for hitching the trailer to a work vehicle, such as a tractor or a truck. In this manner, the trailer can be pushed or pulled from the tobacco fields into the curing cells.

Preferably, the elevating trailer according to the present invention also includes a plurality of detachable tobacco rod holding arms which can be detachably mounted to the frame structure of the trailer at convenient positions therearound. The holding arms include clamping means so that workers can secure tobacco rods to the arms in such a manner so that they can easily impale tobacco stalks onto the tobacco rods. Preferably, the trailer also comprises a tobacco rod reservoir attached to the frame structure for storing an ample supply of empty tobacco rods.

In an alternative preferred embodiment of the present invention, the transportable elevating trailer comprises a wheeled undercarriage; oppositely faced parallel tobacco rod carrying members raisably supported on the wheeled undercarriage and running lengthwise relative the trailer. In this embodiment, the tobacco rod carrying members may rest directly on the wheeled undercarriage and the elevating means are operatively connected between the carrying members and the wheeled undercarriage.

In another preferred embodiment of the present invention, apparatus is provided for carrying and transporting tobacco impaled on tobacco rods into a curing cell and for positively placing and depositing the tobacco rods upon racks in the curing cell, the apparatus comprising a work vehicle; an elevating trailer including a wheeled undercarriage and a scaffold superstructure supported on the wheeled undercarriage; means for hitching the elevating trailer to the work vehicle; oppositely facing tobacco rod carrying members supported generally atop the scaffold superstructure; means for maintaining the tobacco rods in predetermined posi7 tions along the tobacco rod carrying members; and means for selectively raising and lowering the tobacco rod carrying member in a level manner relative to the work vehicle and the wheeled undercarriage, the raising and lowering means including lifting apparatus carried by the trailer for elevating the back portion thereof and lifting apparatus carried by the work vehicle for elevating the front portion of the trailer.

To further achieve the objects and in accordance with the purpose of the invention, as embodied and broadly described herein, a method is provided for gathering and transporting burley tobacco to a curing cell which has holding racks for storing the tobacco for curing. The method according to the present invention comprises the steps of impaling cut burley tobacco stalks onto tobacco rods; placing the tobacco rods across tobacco rod carrying members of a wheeled elevating scaffold trailer at predetermined intervals; elevating the wheeled scaffold trailer to a height above the holding racks in the curing cell; transporting the wheeled elevating scaffold trailer into the curing cell with a work vehicle hitched to the elevating scaffold trailer; and subsequently lowering the wheeled trailer to a height below the holding racks in the curing cell so that the tobacco rods are transferred to predetermined positions along the holding racks as the scaffold trailer passes below and between the level of the holding racks.

Preferably, the method according to the present invention includes the steps of clamping empty tobacco rods to a detachable tobacco rod holding arm posi7 tioned on the trailer and impaling a number of cut tobacco stalks on each side of the clamped tobacco rod; removing the tobacco rod holding arms from the scaffold trailer once the trailer has become loaded with tobacco rods and placing the holding arm upon an empty scaffold trailer for loading of that trailer.

The accompanying drawings, which are incorporated in and constitute a part of the specification, illustrate one embodiment of the invention, and together with the description serve to explain the principles of the invention.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures in which.

Figure 1:
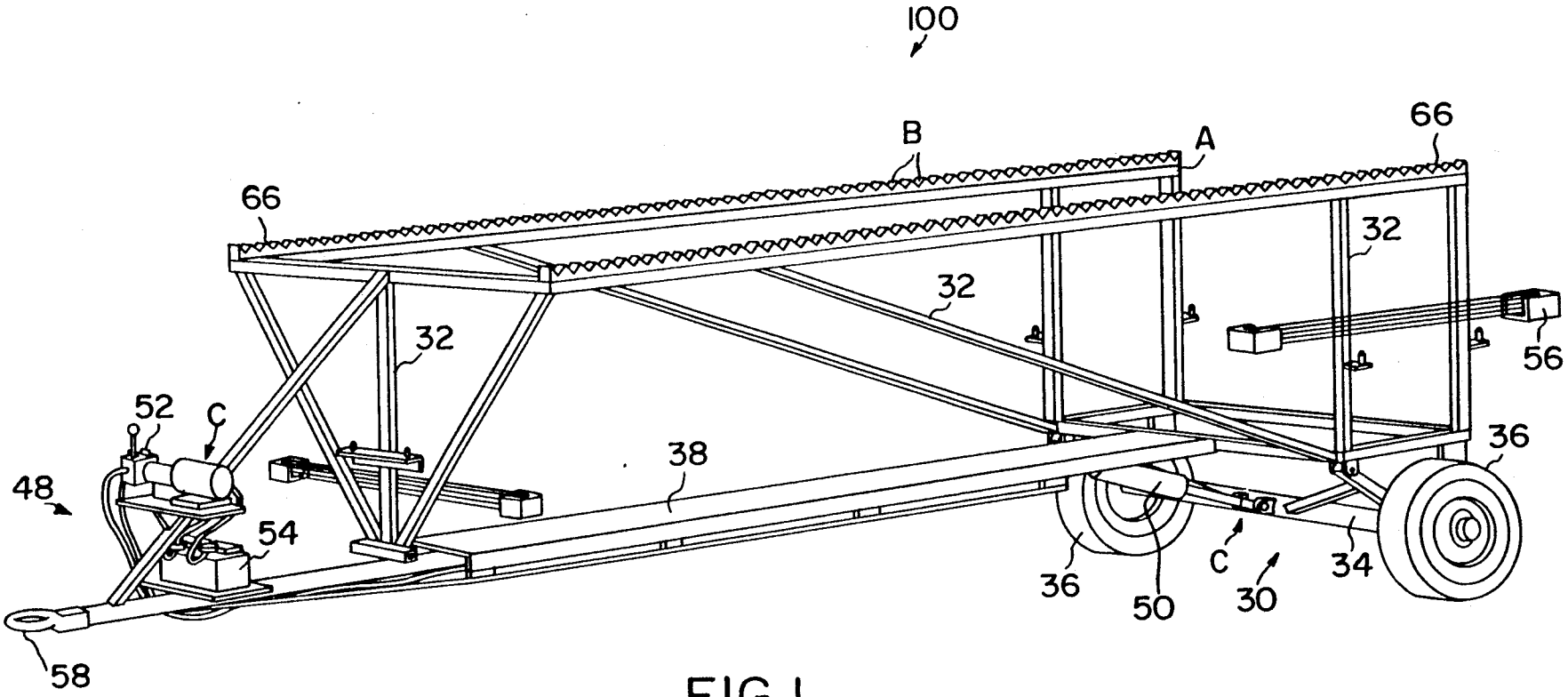
FIG. 1 is a perspective view of a preferred embodi7 ment of the transportable elevating trailer according to the present invention.

Repeat use of reference characters in the following specification and appended drawings is intended to represent the same or analogous features, elements, or steps of the present invention.

BRIEF DESCRIPTION OF THE PREFERRED EMBODIMENTS

Reference will now be made in detail to the presently preferred embodiments of the invention, one or more examples of which are illustrated in the drawings. Each example is provided by way of explanation of the invention, not limitation of the invention. In fact, it will be apparent to those skilled in the art that various modifi7 cations and variations can be made in the present invention without departing from the scope or spirit of the invention. For instance, features illustrated or described as part of one embodiment, can be used on another embodiment to yield a still further embodiment. Thus, it is intended that the present invention cover such modi7 fications and variations as come within the scope of the appended claims and their equivalents.

Referring to FIG. 1, a transportable elevating trailer for carrying tobacco impaled on tobacco rods and for positively placing and depositing the rods upon holding racks within a curing cell is depicted generally as numeral 100. Trailer 100 comprises wheeled base 30, generally upright frame structure 32 raisably supported on wheeled base 30, means A for carrying tobacco rods, carrying means A being supported by frame structure 32 generally at the top thereof and running generally lengthwise along frame structure 32; means B for posi7 tioning tobacco rods along carrying means A at predetermined intervals, positioning means B being disposed along carrying means A; and means C for controllably elevating frame structure 32 so that the frame structure can be raised and lowered a predetermined height relative wheeled base 30. Elevating means C are operatively connected between frame structure 32 and wheeled base 30 whereby carrying means A can be raised to a height above holding racks within a tobacco curing cell and trailer 100 can be moved into the curing cell. Subsequently, carrying means A can be lowered to height below the holding racks so that tobacco rods carried by carrying means A are deposited upon the curing cell holding racks as carrying means A are lowered below and between the level of the holding racks by elevating means C.

Figure 8:
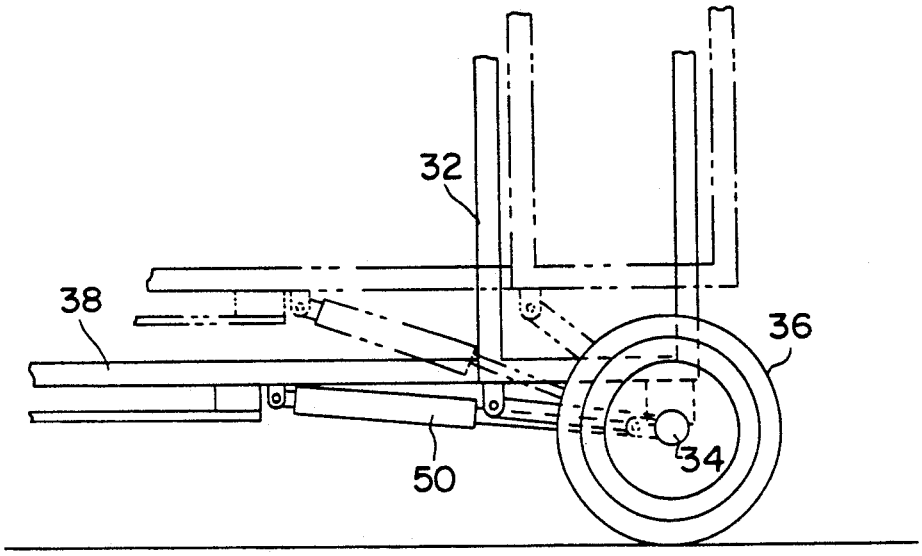
FIG. 8 is a partial perspective view of the wheeled base or undercarriage of the present invention with the frame structure or scaffold trailer raisably supported thereon and particularly illustrates a hydraulic piston arrangement according to the invention.

In the embodiment shown in FIG. 1, wheeled base 30 comprises axle 34 with attached wheels 36. Frame structure 32 is pivotally supported on axle 34. Wheeled base 30 may comprise any number of axles with attached wheels and is not limited to the single axle depicted in FIG. 1. Frame structure 32 is pivotally supported on wheeled base 30, preferably on axle 34, by any conventional manner. For example, in the embodi7 ment depicted in FIG. 1 and FIG. 8, rigid structural members connect frame structure 32 to axle 34. These rigid structural members may be attached for instance with a simple mechanical pin arrangement.

Figure 9:
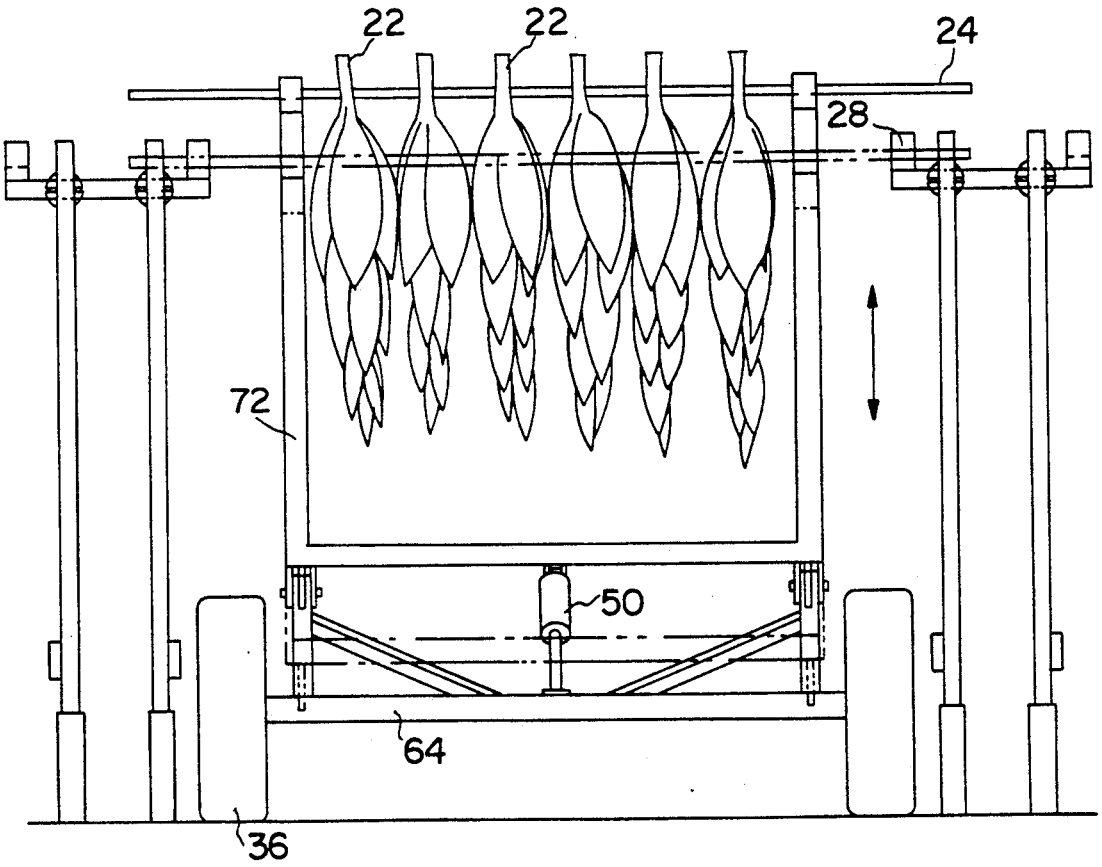
FIG. 9 is a rear perspective view of the elevating trailer according to the invention shown in its elevated position within a curing cell and with fully loaded tobacco rods being carried thereon. The phantom lines shown in the figure depict the elevating trailer in its lowered position with the tobacco rods being deposited upon the holding racks of the curing cell.

In the embodiment depicted in FIG. 9, wheeled undercarriage 64 is provided. Undercarriage 64 may comprise a wheeled structure disposed generally under the frame structure and include any number of axles with attached wheels. In this embodiment, frame structure 32 would be raised and lowered relative to the entire wheeled undercarriage 64. For mechanical and weight considerations however, it is preferred to use a single axle wheeled base 30.

Figure 2:
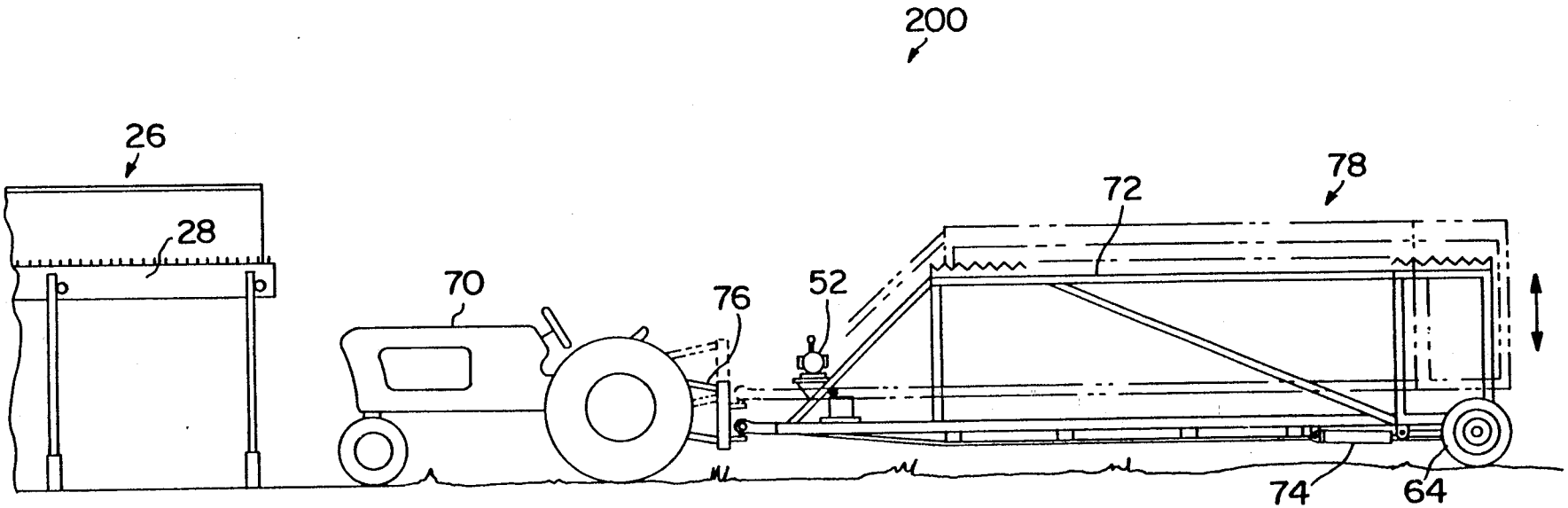
FIG. 2 is a perspective representation of a preferred apparatus according to the present invention and illustrates the elevating trailer hitched to a work vehicle for pulling the trailer into the curing cell. The phantom lines represent the different height positions of the elevating trailer.

Frame structure 32 of the invention can comprise virtually any manner of scaffolding framework and is not limited to the support structure as illustrated in FIG. 1. For example, any number of vertical arms may be disposed lengthwise of the trailer. Frame structure 32 need only have enough structure to support carrying means A. Frame structure 32 may be comprised of any suitable material, such as steel or any other strong rigid material. In the embodiment of FIG. 2, a scaffold superstructure 72 is provided. Scaffold superstructure 72 need not comprise a single integral component, but may consist of any number of rigid structure members which may be readily assembled and disassembled to form the elevating trailer according to the invention. Superstructure 72 may also comprise a structure which is foldable or collapsible.

Figure 3:
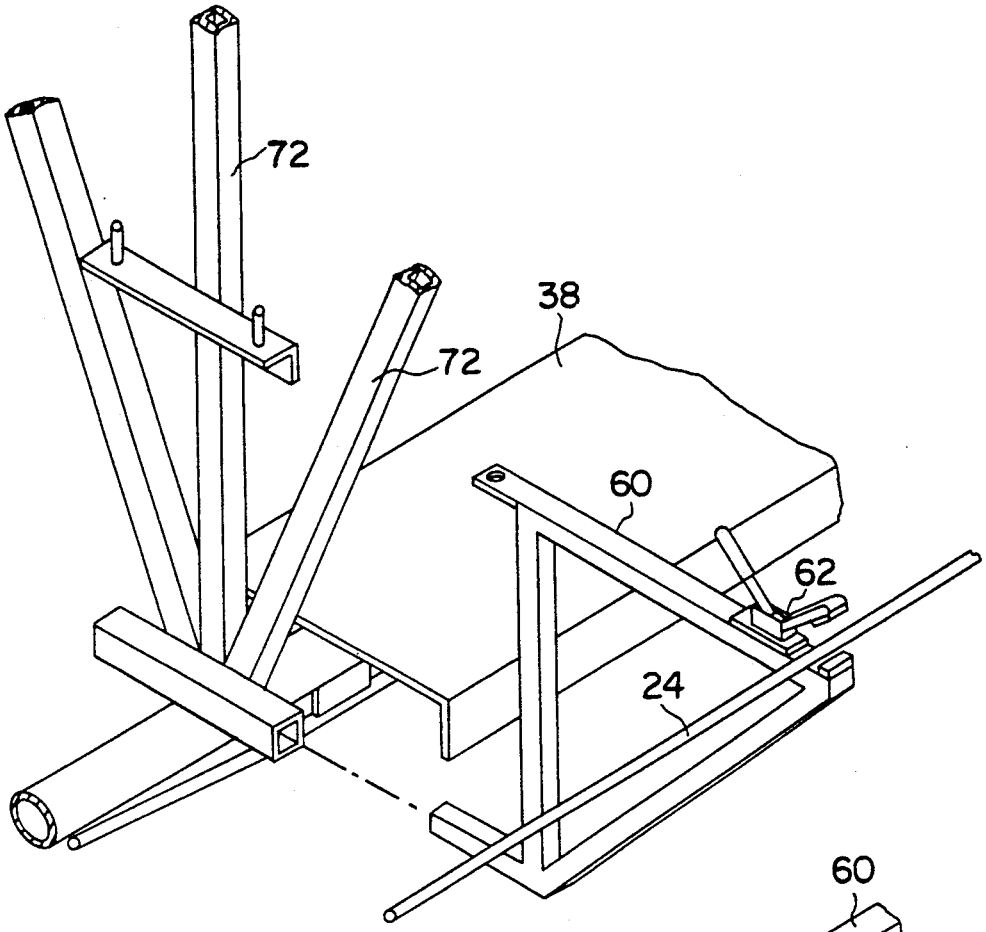
FIG. 3 is a partial representation of the frame structure according to the present invention particularly illustrating the removable tobacco rod holding arms and the clamping means according to the invention.

In a preferred embodiment of the invention, frame structure 32 or scaffold superstructure 72 also comprises walkway 38 disposed generally below and between carrying means A so that workers can walk on walkway 38 to deposit tobacco rods upon carrying means A. Walkway 38 may comprise a simple gangplank arrangement, as shown in FIG. 1 and FIG. 3.

Figure 7:
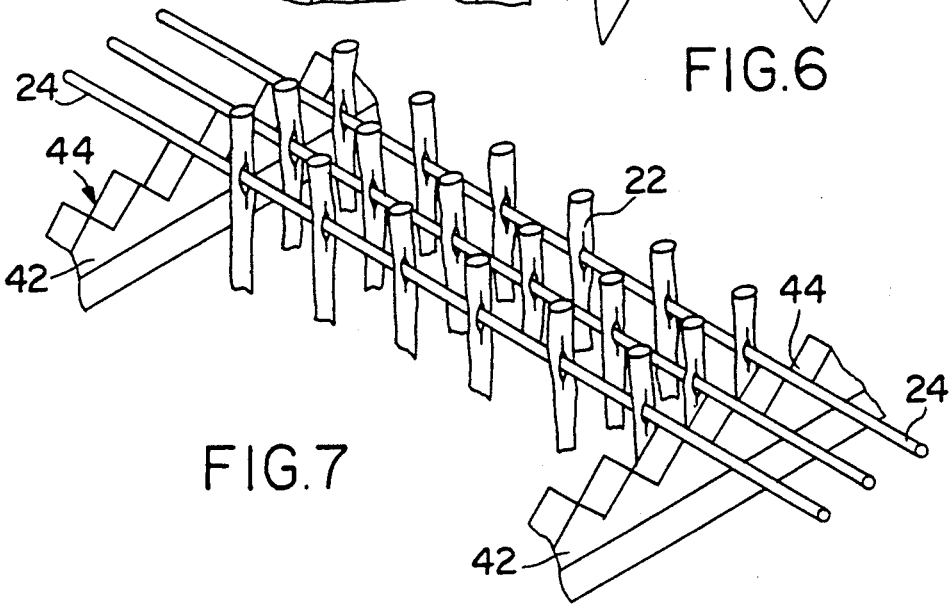
FIG. 7 is a partial perspective view of the tobacco rod carrying means according to the present invention which are illustrated as elongated boards or rails having recesses defined therein for holding the tobacco rods in place.

Carrying means A according to the invention may comprise elongated rails 40 secured to frame structure 32 opposite each other. Rails 40 are spaced apart a distance less than the length of a tobacco rod so that a portion of the tobacco rod extends over each rail 40. Rails 40 can comprise any suitable material, for example steel. In a preferred embodiment depicted in FIG. 7, carrying means A comprise boards 42. FIG. 7 clearly depicts tobacco rods 24 with tobacco stalks 22 being impaled thereon and with the opposite ends of tobacco rods 24 extending beyond boards 42. Boards 42 may be pre-cut in any desired pattern, such as the zigzag pattern depicted in FIG. 7. The desired pattern preferably defines a number of alternating recesses for maintaining tobacco rods 24 in place along boards 42, as will be fully discussed below.

Positioning means B according to the invention may comprise alternating recesses 44 disposed along carrying means A, particularly along boards 42 as depicted in FIG. 7. Recesses 44 define resting or positioning points for tobacco rods 24 so that rods 24 are maintained at a fixed distance relative to each other and generally parallel to each other. Although the zigzag pattern depicted in FIG. 7 for boards 42 provides a convenient positioning means B, any type design may be just as suitable. For instance, alternating semicircles may be defined in carrying means B.

Figure 10:
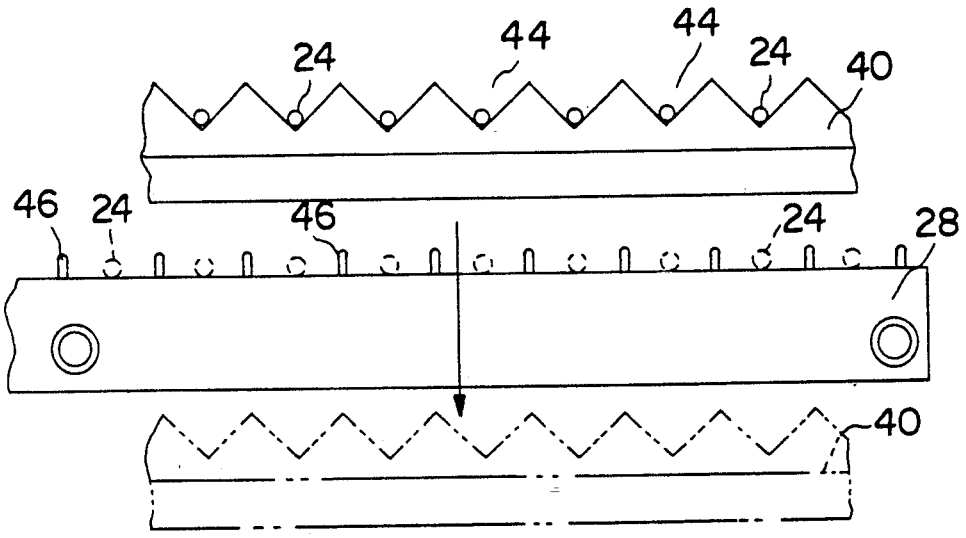
FIG. 10 is a perspective view of the tobacco rod carrying means and holding racks taken along the lines indicated in FIG. 9. The phantom lines in the figure depict the carrying means being lowered below the holding racks with the tobacco rods thereby being deposited upon the holding racks.

In another embodiment, positioning means B may comprise alternating protuberances projecting along carrying means B so that tobacco rods 24 rest between the protuberances. FIG. 10 depicts rails 40 with recesses 44 disposed therealong and tobacco rods 24 resting in recesses 44. Rail 40 is depicted elevated above a holding rack 28 within a curing cell. Holding rack 28 comprises alternating protuberances 46 disposed therealong. Rail 40 could just as easily comprise a flat surface and have protuberances 46 extending therefrom, similar to holding rack 28. Likewise, holding rack 28 could also contain recesses 44. As is illustrated in FIG. 10 by the phantom lines, it is important the positioning means B maintain tobacco rods 24 at fixed intervals along carrying means A which compliment or match intervals defined on holding racks 28 of the curing cells. In this manner, when rails 40 are properly aligned above racks 28 and subsequently lowered, tobacco rods 24 are transferred or deposited at the intervals defined on racks 28.

Elevating means C according to the invention may comprise a hydraulic lifting apparatus 48, as in FIG. 1. Hydraulic lifting apparatus 48 may include at least one hydraulic piston arrangement 50 connected between wheeled base 30 or wheeled undercarriage 64 and frame structure 32 or scaffold superstructure 72 respectively. The operation of hydraulic lifting apparatus 48, particularly hydraulic piston arrangement 50, is more clearly shown in FIGS. 2, 8, and 9 by the phantom lines. In the embodiment shown in the figures, piston arrangement 50 is in its extended position when frame structure 32 is at its lowest position. When piston 50 is caused to retract, it pulls on frame structure 32 causing the structure to pivot or rotate upwards.

Elevating means C may comprise any known conventional lifting arrangement and need not be limited to the single acting piston 50 depicted in the figures. For example, elevating means C may comprise any number of vertically disposed lifting pistons which simply raise and lower frame structure 32 without causing the structure to pivot or rotate around axle 34. Likewise, elevating means C may comprise a winch and pulley arrangement or gear mechanism for mechanically hoisting or raising frame structure 32. Any conventional means for controllably and selectively raising and lowering frame structure 32 may be employed as elevating means C.

In one preferred embodiment of the invention as shown in FIGS. 1 and 2, hydraulic lifting apparatus 48 comprises control station 52 and power supply 54 mounted or carried by trailer 100. In the figures, power supply 54 comprises a battery for driving an electric motor controlled by control station 52. The electric motor operates the hydraulic lifting apparatus 48. Control station 52 and power supply 54 need not be mounted on trailer 100, but could be positioned on or comprise a part of the work vehicle which is employed to transport trailer 100. For example, many farm tractors comprise their own hydraulic system. Hydraulic lifting apparatus 48 may comprise a simple connection to the hydraulic system of the tractor, whereby piston arrangement 50 is actuated by the tractor's hydraulic system.

Trailer 100 may also comprise at least one tobacco rod reservoir 56 carried by frame structure 32, as shown in FIG. 1. Reservoir 56 may be mounted at any convenient location on frame structure 32. Reservoir 56 may comprise a simple box type arrangement for storing spare tobacco rods. Tobacco reservoir 56 may comprise a quiver like arrangement instead of the open boxes shown in FIG. 1. Trailer 100 may also include a hitching means 58, as in FIG. 1, for hitching trailer 100 to a work vehicle 70, as shown in FIG. 2. Trailer 100 may be pushed or pulled by the work vehicle. Any conventional hitch may be employed as hitching means 58.

Figure 4:
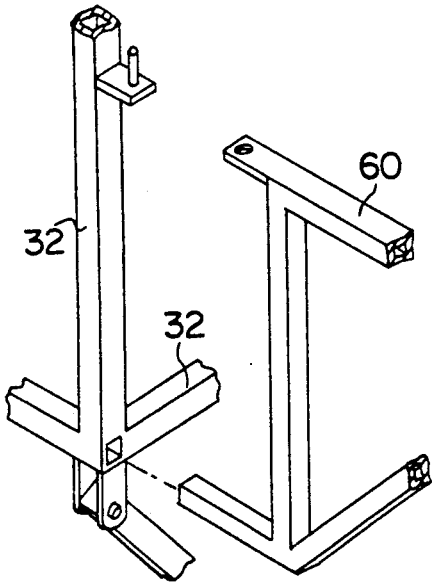
FIG. 4 is another partial representation of the frame structure and detachable tobacco rod holding arms.
Figure 5:
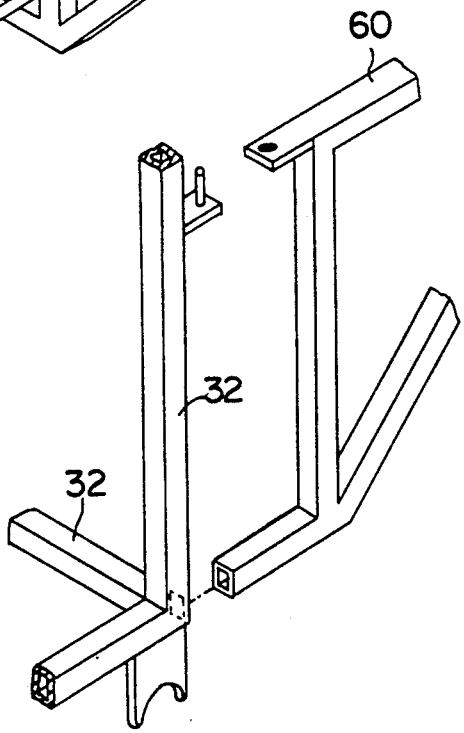
FIG. 5 is yet another partial representation of the frame structure and tobacco rod holding arms according to this invention.
Figure 6:
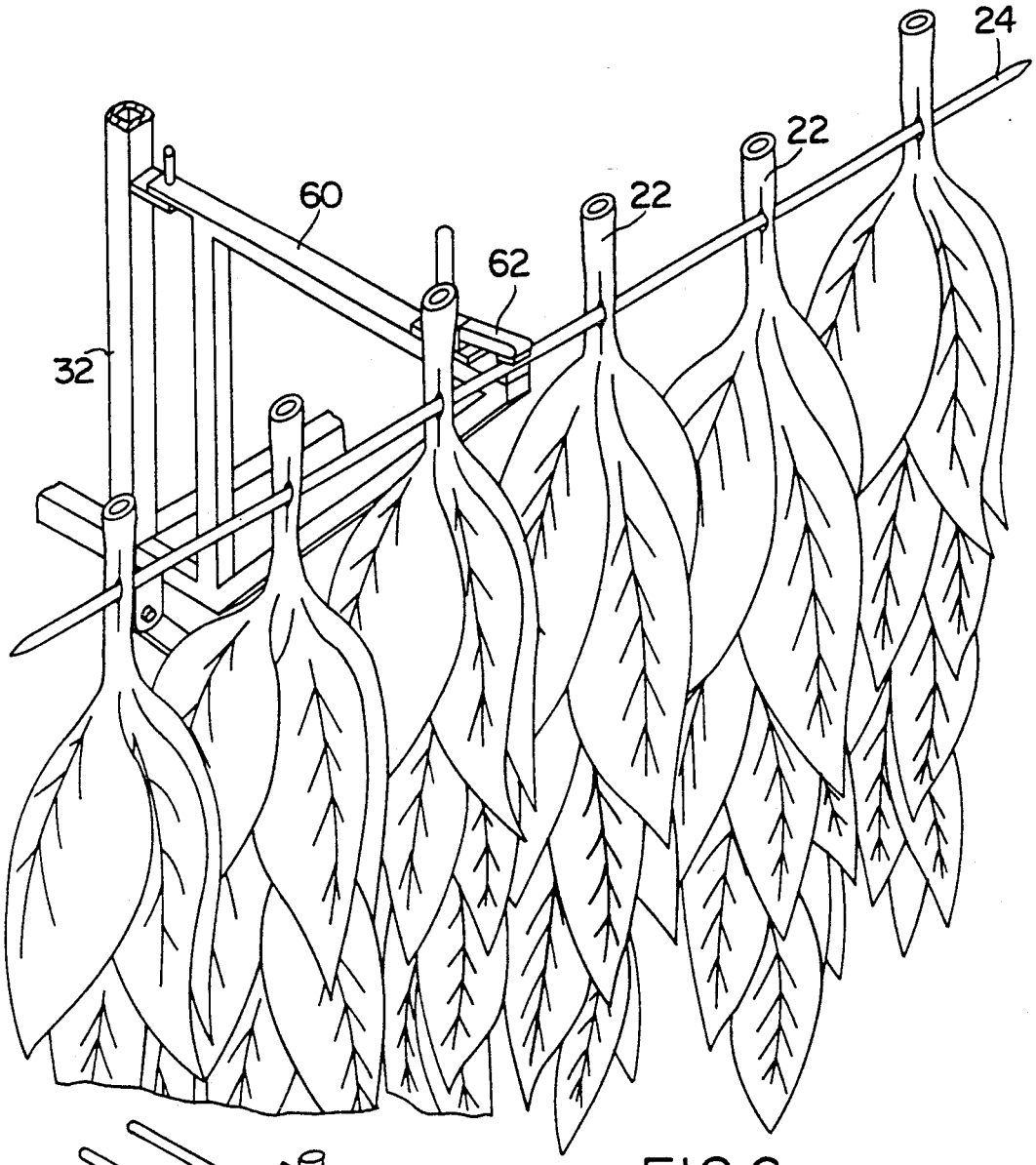
FIG. 6 is a perspective illustration of the tobacco rod holding arms and clamping means according to the invention securing a tobacco rod which has burley tobacco stalks impaled thereon.

Trailer 100 also preferably comprises at least one detachable tobacco rod holding arm 60, as illustrated in FIGS. 3-5. Holding arms 60 detachably mount to frame structure 32 or scaffolding 72 with, for instance, a simple pin engagement mechanism as illustrated in the figures. Arms 60 can be of any configuration or design and can employ any conventional mounting means. Holding arms 60 further include clamping means 62 for clamping tobacco rods so that workers can impale cut tobacco stalks onto the tobacco rods. In a preferred embodiment, clamping means 62 is configured to clamp a tobacco rod 24 to holding arm 60 generally around the middle of the tobacco rod so that a worker can impale an equal number of tobacco stalks on each side of rod 24. Any number of known conventional clamping devices can be utilized as clamping means 62. Holding arms 60 are detachable so that a worker can remove the arms from trailer 100 when that particular trailer has been fully loaded with tobacco stalks. Holding arm 60 is then mounted to the next available empty trailer.

Referring to FIG. 2, apparatus 200 is depicted for carrying and transporting tobacco impaled on tobacco rods into curing cell 26 and for positively placing and depositing the tobacco rods upon racks 28 in the curing cell. Curing cell 26 can comprise any manner of structure or building for storing tobacco for curing. For example, the curing cell may comprise an existing warehouse modified with racks 28. Alternatively, the curing cell may comprise a portable cell erected at a preselected site.

Apparatus 200 includes work vehicle 70 and elevating trailer 78. Elevating trailer 78 is essentially the same as trailer 100 previously discussed. Although FIG. 2 depicts work vehicle 70 as being hitched to trailer 78, it should be understood that work vehicle 70 and trailer 78 may comprise a single integral apparatus. In other words, trailer 78 may contain its own transportation means and can be driven directly.

Apparatus 200 may also include lifting apparatus 74 carried by the trailer for elevating the back portion thereof, and lifting apparatus 76 carried by work vehi7 cle 70 for elevating the front portion of the trailer. As mentioned, farm vehicles often contain their own hydraulic system. Lifting apparatus 76 carried by the work vehicle may comprise a portion of the work vehicle's hydraulic system. In the embodiment depicted in FIG. 2 wherein trailer 78 is hitched to work vehicle 70, the tractor's lifting mechanism 76 raises the front end of trailer 78, as shown by the phantom lines in the figure. The opposite ends of trailer 78 may be raised simultaneously or in succession where one end is raised to a predetermined height and the other end is then raised to that height. Control station 52 for the lifting apparatus may be disposed on the trailer 78 or on work vehicle 70.

In operation, scaffold superstructure 72 or frame structure 32 is lowered by elevating means C to a convenient height so that workers can place tobacco laden tobacco rods 24 upon carrying means A. Once carrying means A have been filled with tobacco rods 24, elevating means C raises frame structure 32 to a height above that of the holding racks 28 within curing cell 26. Trailer 100 is then pushed or pulled into the curing cell by work vehicle 70. Curing cell 26 contains oppositely faced holding racks 28 spaced apart at such a distance that trailer 100 can be driven therebetween. Trailer 100 is stopped and positioned so that tobacco rods 24 lie directly above their receptacle positions on holding racks 28, as is shown in FIGS. 9 and 10. The worker then lowers frame structure 32 with elevating means C. As carrying means A pass below the level of holding racks 28, the tobacco rods are transferred to holding racks 28, as illustrated in FIG. 10. Once the rods have been transferred to the holding racks, work vehicle 70 pushes or pulls trailer 100 out of the curing cell and can then return it to the tobacco field for further loading. Once the tobacco has cured, trailer 100 can be used to pick up rods 24 from racks 28 by reversing the operation just described.

The method according to the present invention is depicted generally in the figures and comprises the steps of impaling cut burley tobacco stalks 22 onto tobacco rods 24; placing rods 24 across tobacco rod carrying members 40 or 42 of a wheeled elevating scaffold trailer 100 at predetermined intervals therealong; elevating trailer 100 to a height above that of holding racks 28 in a curing cell 26; transporting trailer 100 into curing cell 26 between holding racks 28 with work vehicle 70 hitched to trailer 100; and lowering trailer 100 to a height below holding racks 28 so that tobacco rods 24 are transferred to redetermined positions along holding racks 28 complementing the predetermined positions along the tobacco rod carrying members as scaffold trailer 100 passes below and between the level of holding racks 28.

The method according to the present invention may further include clamping empty tobacco rods 24 to detachable tobacco rod holding arms 60 prior to the impaling step, whereby the clamping step generally comprises clamping an empty tobacco rod 24 to holding arm 60 generally at the center of rod 24 and impaling a number of cut tobacco stalks 22 on each side of the clamped rod 24.

It will be apparent to those skilled in the art that various modifications and variations can be made in the apparatus and method of the present invention without departing from scope or spirit of the invention. For example, frame structure 32 or scaffold trailer 72 of the invention can comprise virtually any configuration or arrangement of support elements. Thus, it is intended that the present invention cover the modification and variations of this invention provided they come within the scope of the appended claims and their equivalents.

What is claimed is:

1. An elevating tobacco trailer for transporting tobacco laden tobacco rods into or out of a curing cell of the type having holding racks across which the tobacco laden rods are placed, said trailer comprising:

a steerable wheeled base, said wheeled base configured to be connected to a work vehicle;

a generally upright frame structure raisably supported on said wheeled base;

oppositely faced parallel tobacco rod carrying members supported by said frame structure, said carrying members spaced apart a distance so that tobacco rods which may be carried by said carrying members overhang each of said carrying members, said carrying members supported by said frame structure at a height so that tobacco stalks impaled on said tobacco rods carried by said carrying members hang freely within said frame structure between said carrying members;

means for positioning said tobacco rods along said carrying members at predetermined intervals;

means for raising and lowering said frame structure relative said wheeled base, said raising and lowering means operatively connected between said frame structure and said wheeled base; and whereby said trailer is movable into or out of said curing cell between said holding racks with said carrying members in a raised position, said carrying members being raised or lowered between said holding racks for depositing said tobacco rods upon said holding racks or picking up said tobacco rods from said holding racks.

2. A trailer as in claim 1, wherein said wheeled base comprises an axle with attached wheels with said frame structure pivotally supported relative said axle.

3. A trailer as in claim 1, wherein said frame structure comprises a walkway disposed below and generally between said carrying members so that workers can walk on said walkway between said carrying members to deposit said tobacco rods upon said carrying members.

4. A trailer as in claim 1, wherein said carrying members comprise boards pre-cut in a desired pattern.

5. A trailer as in claim 4, wherein said positioning means comprises alternating recesses cut into said boards.

6. A trailer as in claim 1, wherein said positioning means comprises alternating recesses disposed along said carrying members.

7. A trailer as in claim 1, wherein said positioning means comprises alternating protuberances extending along said carrying members.

8. A trailer as in claim 1, wherein said raising and lowering means comprises a hydraulic lifting apparatus.

9. A trailer as in claim 8, wherein said hydraulic lifting apparatus comprises at least one hydraulic piston arrangement connected between said wheeled base and said frame structure.

10. A trailer as in claim 8, wherein said hydraulic lifting apparatus comprises a control station and a power supply carried by said trailer.

11. A trailer as in claim 1, further comprising a tobacco rod reservoir carried by said frame structure.

12. A trailer as in claim 1, further comprising means for hitching said trailer to the work vehicle.

13. A trailer as in claim 1, further comprising at least one detachable tobacco rod holding arm, said holding arm being configured for detachably mounting to said frame structure.

14. A trailer as in claim 13, wherein said holding arm comprises means for clamping tobacco rods thereto so that workers can impale cut tobacco stalks onto the tobacco rods.

15. A trailer as in claim 1, further comprising:

said work vehicle being removably hitched to said wheeled base, said raising and lowering means including a lifting apparatus carried by said trailer for elevating the back portion of said frame structure and lifting apparatus carried by said work vehicle for elevating a front portion of said frame structure.

16. A trailer as in claim 15, wherein said lifting apparatuses comprise a hydraulic lifting arrangement operatively configured to raise and lower a back end and front end of said tobacco rod carrying members in sequence.

17. A trailer as in claim 15, wherein said raising and lowering means comprises a control station on said work vehicle.

18. A trailer as in claim 15, wherein said raising and lowering means comprises a control station on said frame structure.

19. A trailer as in claim 15 further comprising a tobacco rod reservoir carried by said frame structure, and a plurality of detachable tobacco rod holding arms, said holding arms being configured for mounting at selected positions to said frame structure, said tobacco rod holding arms including means for clamping the tobacco rods thereto so that workers can impale cut tobacco stalks onto the tobacco rod.

20. The trailer as in claim 1, wherein said frame structure is also articulable relative said wheeled base, said raising and lowering means operatively connected between said wheeled base and said frame structure so that said frame structure is displaced horizontally relative said wheeled base as said frame structure is raised or lowered.

* * * * *